US006244249B1

(12) United States Patent
Zoeller

(10) Patent No.: US 6,244,249 B1
(45) Date of Patent: Jun. 12, 2001

(54) FUEL-INJECTION DIESEL INTERNAL-COMBUSTION ENGINE

(75) Inventor: Herbert Zoeller, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/265,956

(22) Filed: Mar. 11, 1999

Related U.S. Application Data

(63) Continuation of application No. PCT/EP97/04914, filed on Sep. 5, 1997.

(30) Foreign Application Priority Data

Sep. 11, 1996 (DE) ..... 196 36 896

(51) Int. Cl.[7] ..... B27B 19/00
(52) U.S. Cl. ..... 123/467
(58) Field of Search ..... 123/496, 467, 123/500, 501, 357

(56) References Cited

U.S. PATENT DOCUMENTS

| | | | | |
|---|---|---|---|---|
| 1,944,371 | * | 1/1934 | Ritz | 123/467 |
| 4,036,192 | * | 7/1977 | Nakayama | 123/467 |
| 4,211,203 | * | 7/1980 | Kodayashi | 123/496 |
| 4,229,148 | * | 10/1980 | Richmond | 123/496 |
| 5,241,935 | * | 9/1993 | Beck | 123/467 |
| 5,533,481 | | 7/1996 | Kronberger | 123/299 |
| 5,605,134 | * | 2/1997 | Martin | 123/467 |
| 5,901,685 | * | 5/1999 | Noyce | 123/467 |

FOREIGN PATENT DOCUMENTS

| | | |
|---|---|---|
| 31 29 916 | 7/1982 | (DE) . |
| 688 950 | 12/1995 | (EP) . |
| 2 083 861 | 3/1982 | (GB) . |

* cited by examiner

*Primary Examiner*—Carl S. Miller
(74) *Attorney, Agent, or Firm*—Evenson, McKeown, Edwards & Lenahan, P.L.L.C.

(57) ABSTRACT

A fuel injection diesel internal-combustion engine, having a fuel injection nozzle and having a spring chamber for the pressure spring acting upon the nozzle needle. The spring chamber is constructed as a closed chamber without a leak oil connection and forms a space which is under a fuel pressure. The spring chamber fills with fuel, by way of a slide guide for the pressure linkage of the nozzle needle constructed as a throttling point. As the fuel pressure in the spring chamber rises above an operating pressure corresponding to the control position of the injection pump for the defined driving condition, the delivery time of the pump is prolonged for compensating the lowering of the injection quantity connected with the pressure rise in the spring chamber.

13 Claims, 3 Drawing Sheets

FUEL-INJECTION DIESEL INTERNAL-COMBUSTION ENGINE

CROSS-REFERENCE TO RELATED APPLICATIONS

This application is a continuation under 35 U.S.C. 111(a) of pending international PCT Application No. PCT/EP97/04914, filed Sep. 5, 1997, and claims the priority of German application number 196 36 896.0, filed on Sep. 11, 1996, the disclosures of which are incorporated by reference herein.

BACKGROUND AND SUMMARY OF THE INVENTION

The invention relates to a fuel-injection diesel internal-combustion engine having an injection pump which, with respect to the delivery quantity, the delivery pressure and/or the delivery time, is controlled as a function of the load and/or the rotational speed. An injection nozzle is connected in the feed line to the delivery side of the pump and, by way of at least one injection opening, leads out to a combustion space of the internal-combustion engine. The injection opening can be closed by way of a nozzle needle which, in the opening direction, can be displaced by way of the fuel delivered on the delivery side by the pump and is loaded in the closing direction by way of a pressure spring. The pressure spring is arranged in a closed no-discharge spring chamber which is connected with the delivery side of the pump by way of a throttling point which is formed by a sliding guide for the nozzle needle. The sliding guide, in addition to being loaded by the pressure spring, is loaded in the closing direction by way of the fuel pressure existing in the spring chamber filled with fuel. The fuel pressure existing in the spring chamber is variable and is a function of the control position of the injection pump corresponding to the defined driving condition.

Fuel-injection diesel internal-combustion engines are known from German Patent Document DE 31 29 916 A1. In the inflow of the nozzle connected to the delivery side of the pump, a constant-volume relief pressure valve is provided on the pump outlet side. A force of the pressure spring is experimentally determined for a defined internal-combustion engine and a defined rotational speed and load range of this internal-combustion engine, at which force, in the stabilized condition of the internal-combustion engine, at an arbitrary point of its working regime, a constant cycle delivery quantity, that is, injection quantity is to be ensured. This is the result of the fact that, relative to this working point, the residual pressure in the feed line to the nozzle as well as the residual pressure in the spring chamber are held at the same level.

In the fuel-injection diesel internal-combustion engines of the initially mentioned type, the phenomenon is to be countered that, under stabilized conditions, there is usually a progressive increase of the residual pressure in the feed line from the pump to the nozzle and in the spring chamber. As a result, while the control position of the injection pump is the same, the amount of the injection quantity will gradually fall until there will finally be a blocking of the injection valve by the fuel pressure in the spring chamber and therefore a reduction of the injection quantity to zero.

In contrast, by means of the known solution, the residual pressure in the spring chamber and in the feed line from the pump to the nozzle is to be maintained at the same level so that a constant injection quantity is ensured for a working point.

According to the invention, the above-described effect, which causes the internal-combustion engine to die due to the lack of a fuel supply, is to be avoided over the whole working range of the engine and therefore a corresponding injection system for internal-combustion engines of motor vehicles is to be utilized which can be used over the whole working range.

This is achieved by the invention in that a rise of the pressure in the spring chamber is to be countered by way of an operating pressure corresponding for a defined driving condition to the control position of the injection pump by increasing the delivery time of the pump. If the delivery time is increased, a higher delivery pressure is obtained which the pressure in the spring chamber constructed as the pressure chamber can follow only in a delayed manner because of the throttling point situated in the connection to the spring chamber, in which case the pressure level will also fall. Correspondingly, by means of the measure according to the invention, the fuel supply of the combustion space of the internal-combustion engine, which is tendentiously reduced by the pressure buildup in the spring chamber, can be compensated and the operation of the internal-combustion engine can be maintained in an undisturbed manner.

The solution according to the invention is particularly important for diesel internal-combustion engines in whose fuel injection high pump pressures and correspondingly high injection pressures are used. For example, in systems without any pipe connection between the pump and the nozzle, which are known as pump-nozzle elements, as well as in systems operating with plug-type pumps, a so-called plug-type pump is located adjacent to the nozzle assigned to the respective combustion space. The plug-type pump is acted upon by way of the cam of a camshaft. In comparison to systems which operate with distributor pumps or in-line injection pumps, very short pipe paths are obtained and therefore advantageous conditions for the work with high injection pressures. High injection pressures are those pressures which are in the range of 1,700 bar, in which case in corresponding systems injection opening pressures of up to 350 bar are used.

If work takes place with such high pressures, very high stress occurs with respect to the nozzles and high spring forces must also be applied in order to achieve corresponding closing forces for the nozzle needle. The high closing and opening forces acting upon the nozzle needle make such systems particularly sensitive to vibrations and these vibrations result in considerable problems concerning noise and wear. The wear problems are partially also indirect because vibrations of the nozzle needle promote the blowing back of burnable gases through the injection opening into the nozzle and thus the coking of the nozzle.

Since the addressed pressures represent peak pressures, significantly lower pump delivery and injection pressures occur for other operating phases of the internal-combustion engine. Nevertheless, a fuel injection diesel internal-combustion engine constructed according to the invention must, in particular, also meet the requirement that it exhibit a correspondingly cultivated running in the idling operation. The invention definitely meets these requirements.

According to the invention, the force of the pressure spring loading the nozzle needle in the closing direction does not have to be designed for the maximal pressures to be controlled but can be selected to be lower. As the result of the no-discharge design of the spring chamber, which is therefore closed with the exception of the opening for the nozzle needle, a pressure builds up in the spring chamber which is superimposed on the spring pressure and is added to it. Since, in addition, this pressure is a function of the respective working pressure of the pump system, an adaptation of the closing pressure acting upon the nozzle needle to the respective pump or injection pressure can be achieved. If the closing pressure must be applied only by the pressure spring, this pressure spring must be designed for the maximal pump or injection pressure as the working pressure; a corresponding adaptation possibility does not exist.

The closed spring chamber acting as the pressure chamber has the result that, during the opening of the nozzle needle by the compression of the fuel in the spring chamber, an additional pressure rise will occur. Since the connection to the spring chamber is constructed as a throttling point, this pressure rise is at least partially compensated by a certain expansion by way of the throttling point, which leads to a damping of vibrations. The result is a stable injection and a lower wear of the nozzle.

Another damping influence can be achieved in that the spring chamber—pressure spring system is, in addition, constructed as a vibration damper. This is achieved by the fact that the pressure spring is radially largely arranged without contact, thus without any significant play with respect to the spring chamber. In the case of such an arrangement, the fuel between the pressure spring and the wall of the spring chamber forms virtually only a film, and damping effects therefore occur because of the occurring fluid friction.

The rising of the pressure in the spring chamber can be detected within the scope of the solution according to the invention directly as well as indirectly, in which case an indirect detection is possible, for example, by way of the rotational speed, the opening point in time of the nozzle needle, the injection time and/or the closing point in time of the nozzle needle.

Because of the increase of the delivery time in the spring chamber, the pressure in the spring chamber can be raised with respect to a limit value to which a closing force corresponds which is exercised on the nozzle needle and which is lower than the increased opening force resulting in connection with the increase of the delivery time.

On the whole, an internal-combustion engine operating with a fuel injection according to the invention is distinguished by a simplified construction because the pump-nozzle system in the connection between the pump and the nozzle can be constructed without valves. Thus, the invention does not require constant pressure relief pressure valves or constant volume pressure relief pressure valves. Furthermore, the invention permits, while high and highest injection pressures are controlled, relatively low opening pressures, not least because of the fuel injection stabilized by the avoidance of vibrations. All this results in a perfect noise behavior, particularly also during idling and in the low partial-load range.

Other objects, advantages and novel features of the present invention will become apparent from the following detailed description of the invention when considered in conjunction with the accompanying drawings.

DETAILED DESCRIPTION OF THE DRAWINGS

Figure 1:
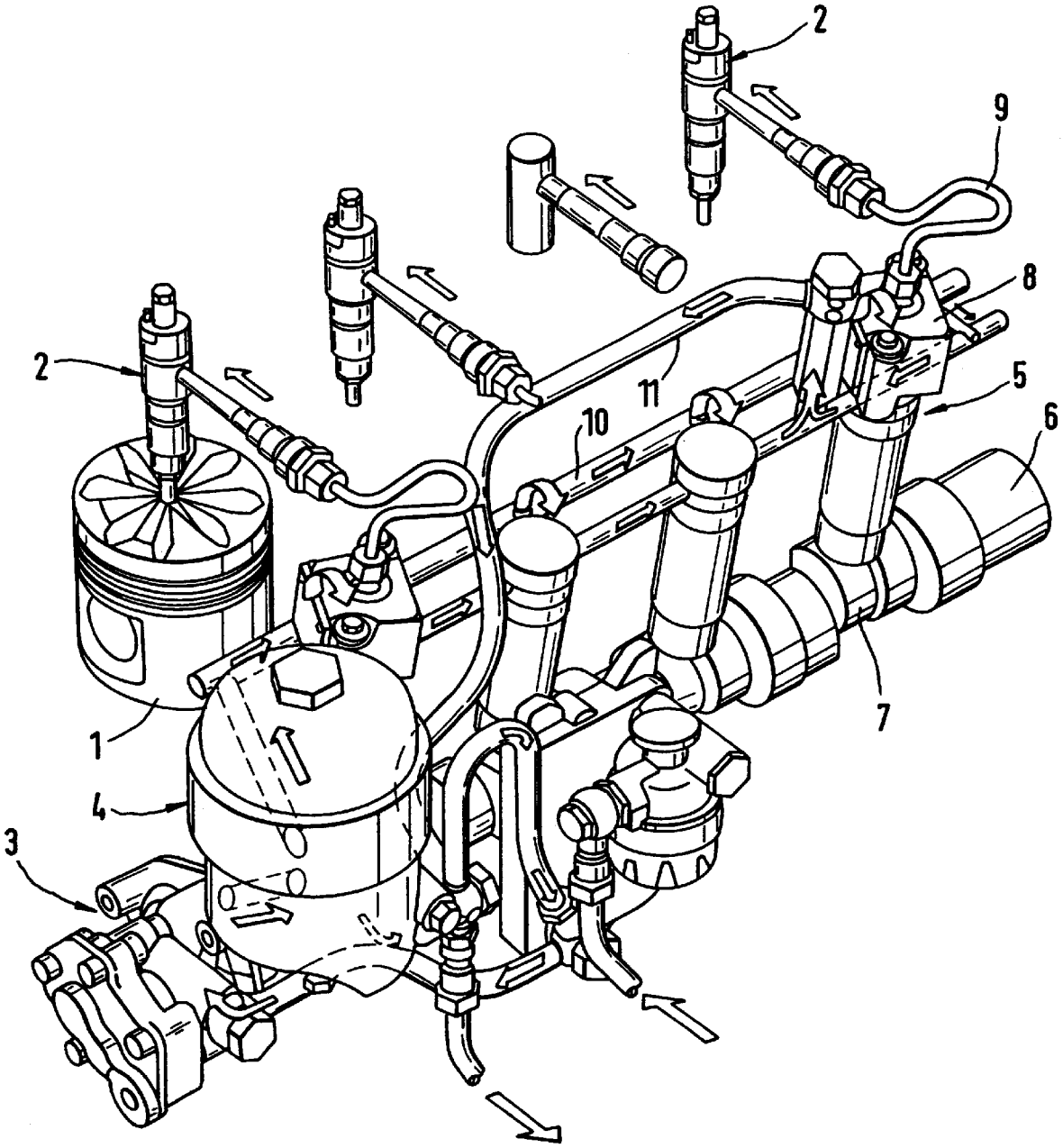
FIG. 1 is a schematic perspective view of parts of a diesel internal-combustion engine and its fuel supply with the pertaining injection system.

The schematic view according to FIG. 1 is based on an in-line engine with four cylinders, in which pistons 1 are provided, of which only one is shown here and above which combustion spaces are situated. Fuel injection nozzles 2 lead out centrally into the combustion spaces which are arranged in the cylinder head, which is also not shown here and which closes off the cylinders toward the top. With respect to the nozzles 2, only the fuel pipe is shown which partially leads toward one of the nozzles.

The fuel supply comprises a fuel delivery pump 3 from which, by way of a filter 4 and pipes 10, fuel is supplied to plug-type pumps 5. The plug-type pumps 5 have return flow connections for the fuel portion not supplied to the fuel nozzles which lead out to a fuel return pipe 11. One plug-type pump 5 is provided for each cylinder, are driven by way of a camshaft 6 which, in addition to the peripheral cams for the valve gear, which is not shown, has pump cams 7. A control unit 8 is assigned to each plug-type pump 5, by way of which control unit 8 the fuel metering to the respective fuel injection nozzle 2 takes place. Only a short pipe section 9 remains between the nozzle 2 and the control unit 8 because of the spatial arrangement. The control units 8, which comprise the corresponding control valves and the like, are, connected with the central engine timing system and are electrically controlled by it. The control valves of the control units, as a rule, are constructed as solenoid valves.

Figure 2:
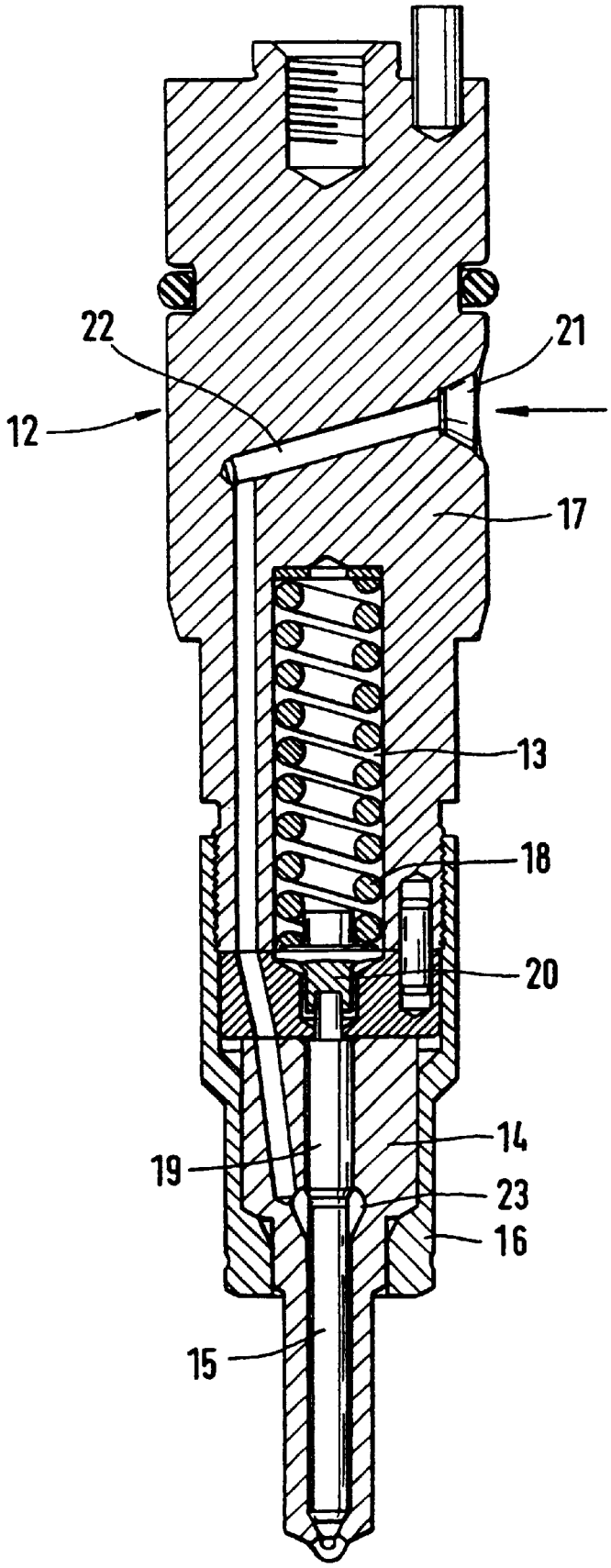
FIG. 2 is a schematic cut-away view of a fuel injection nozzle according to a preferred embodiment of the present invention constructed with only a spring chamber.

The construction of the fuel injection nozzles, which as injection nozzles 2 are shown only schematically in FIG. 1 with their corresponding holding device, is explained in detail by the detailed cut-away view of a fuel injection nozzle 12 in FIG. 2. In a known manner, the fuel injection nozzle 12 comprises a nozzle body 14, in which a nozzle needle 15 is guided which, in the area of its needle point, controls injection bores provided in the nozzle body. By way of a union nut 16, the nozzle body 14 is connected with the nozzle holder 17 which defines a spring chamber 13. A spring 18, which here is constructed as a coil spring, is arranged in the spring chamber 13 situated coaxially with respect to the nozzle needle. At a nozzle-needle-side end, the spring 18 is operatively coupled with the nozzle needle 15 by way of a pressure linkage 19. According to certain preferred embodiments, the pressure linkage 19 may be at least partially, a component of the nozzle needle itself.

The pressure linkage 19 is provided with a spring plate 20 which is situated at the nozzle-side end of the spring chamber 13 and optionally projects into it. At its end opposite the nozzle needle, the spring 18 is supported against the nozzle holder 17.

At reference number 21, the fuel nozzles 12 are connected in a manner not shown in detail to the short pipe 9 leading to the respective plug-type pump 5 (see FIG. 1). The fuel nozzle 12 has a fuel feeding bore 22 extending through the nozzle holder 17 and the nozzle body 14. The fuel feeding bore 22 leads out to an annulus 23, from which fuel flows along the nozzle needle 15 to its tip and displaces it at the corresponding pressure against the force of the spring 18 into an opening position in which the fuel is injected by way of the injection bores into the combustion space.

In connection with the used plug-type pumps 5, the working pressure, that is, the delivery pressure of the pump and the injection pressure in the tip, reaches approximately 1,700 bar. This pressure also exists in the annulus 23 which, with respect to the spring chamber 13 by way of the pressure linkage 19, which may also be constructed in one piece with the nozzle needle, is sealed off with a narrow play such that a throttling point is formed and only a certain leakage quantity can arrive in the spring chamber 13. In the case of the described solution, this leakage quantity leads to a filling of the spring chamber 13 with fuel, in which case, since the spring chamber is constructed without a discharge, that is, without any drainage for the leak oil, a fuel pressure is built up in the spring chamber which is clearly below the described working pressure and also below the opening pressure for the nozzle needle, but is relatively high, for example, in the range of 100 bar. The corresponding pressure reduction with respect to the working pressure is caused by the narrow slide guidance between the pressure linkage 19 and the nozzle body 14, the throttling point also causing the pressure existing in the spring chamber 13 to be somewhat more uniform, but irrespective of this uniformity, fluctuations occurring as a function of the height of the respective working pressure as well as because of the compression which is caused by the lifting of the nozzle needle during the opening of the nozzle.

The fuel charge of the spring chamber 13 in connection with the narrow guidance of the spring 18 in the spring chamber 13, thus in connection with the narrow radial play, by which the spring is guided in a virtually sliding manner in the spring chamber 13, has the result that the spring 18 is additionally also damped and spring vibrations are therefore largely avoided. The slide guide between the pressure linkage 19 and the nozzle body 14, which is constructed as a throttling point, also has a corresponding effect with respect to the lifting vibrations of the nozzle needle because the narrow play in connection with the high existing pressures has a clearly damping effect particularly during the opening of the nozzle needle. As the result, spring vibrations are avoided or at least minimized and lifting vibrations of the nozzle needle are also at least clearly reduced. Corresponding to this hydraulic damping of the nozzle needle 15, a chattering during the closing of the nozzle needle is largely avoided, or at least clearly damped so that, in addition to the fact that the injection becomes more uniform, thus, in addition to a stable injection operation, a reduction of the mechanical wear is also achieved. In addition, the elimination of leak oil bores and of the corresponding connections also reduces the cost of the overall system, particularly since also the connection from the pump 8 to the nozzle 2 is formed by only one line in which constant-pressure relief pressure valves or constant-volume relief pressure valves can be absent.

The construction of the spring chamber 13 as a no-discharge closed spring chamber, thus as a spring chamber which has no leak oil drain and which in the operation is filled completely with fuel which, as explained above, is under a high pressure, has the result that the nozzle needle, in comparison to pressureless spring chambers, thus spring chambers which are connected to a leak oil pipe, must operate against the pressure in the spring chamber, this pressure being superimposed on the spring pressure. As the pressure in the spring chamber rises, higher nozzle opening forces are therefore required, and the injection quantity on the whole will fall with the result of a power drop of the internal-combustion engine and, in an extreme case, with the result of a dying of the internal-combustion engine. Within the scope of the invention, this is countered by the fact that, when the pressure in the spring chamber rises above an operating pressure corresponding to the control position of the injection pump for the defined driving position, the delivery time of the pump is increased. The result is a compensation of the occurring delay, and thus a stabilization of the internal-combustion engine.

Figure 3:
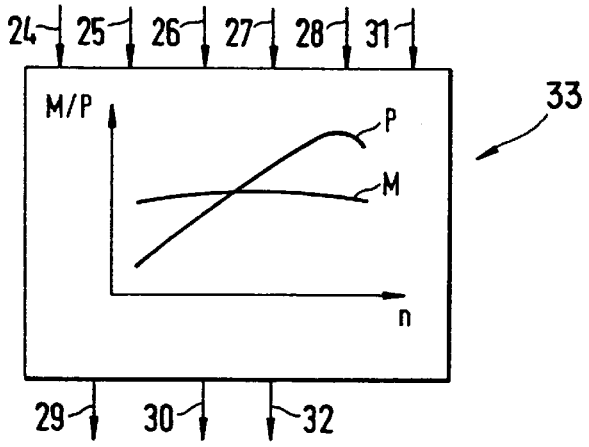
FIG. 3 is a schematic view of a control unit with input and output quantities.

FIG. 3 is a schematic view of the control unit 33 of a central engine timing system which converts a number of input signals to corresponding output signals, by means of which, among others, the control units 8 of the plug-type pumps 5 are controlled. Input quantities, in each case symbolized by an arrow, may, among others, be the rotational speed (arrow 24), the charge air temperature (arrow 25), the accelerator pedal position (arrow 26); additional temperatures, such as the cooling water temperature and/or the fuel temperature (arrow 27), the charge air pressure (arrow 28) and other characteristic quantities (arrow 31), by means of which output signals are determined in conjunction with the characteristic diagrams filed in the control unit, in addition to other signals (arrow 32), among others, the start of the delivery (arrow 29) and the end of the delivery (arrow 30). By means of the characteristic diagrams or when determining the characteristic diagrams, the pressures in the spring chamber which correspond to the respective operating positions of the engine are already taken into account and are taken into account by correspondingly prolonged injection times, thus prolonged time intervals between the start of the delivery and the end of the delivery. Basically, a direct detection of the pressures in the spring chamber and their indirect consideration in the control unit 23 are also contemplated.

Although the prolongation of the delivery time of the pump or increased injection pressures also result in a rise of the pressure in the spring chamber, this pressure rise is decreasing in comparison to the injection pressure and asymptotically approaches a limit value so that the increase of the delivery times is not accompanied by a proportional or even progressive rise of the pressure in the spring chamber.

Figure 4:
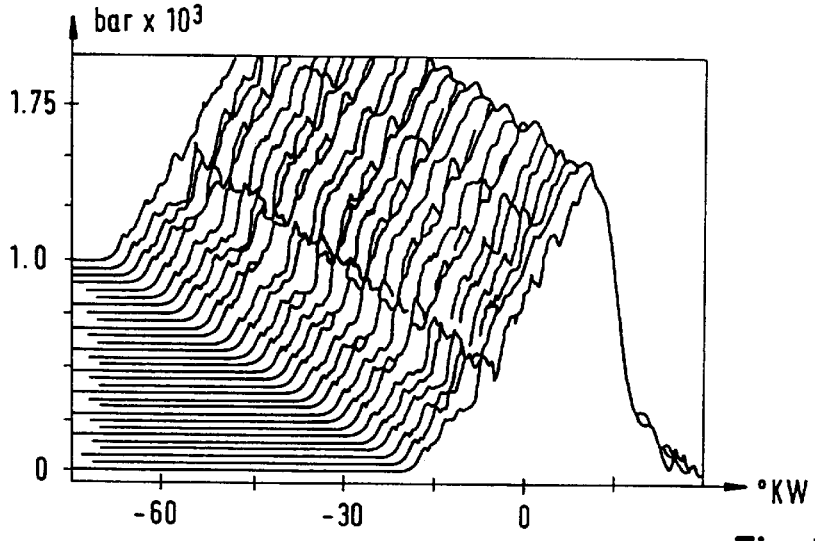
FIG. 4 is a view of the injection pressure course for a diesel internal-combustion engine with an open spring chamber relative to a rotational speed of 2,300 r.p.m.
Figure 5:
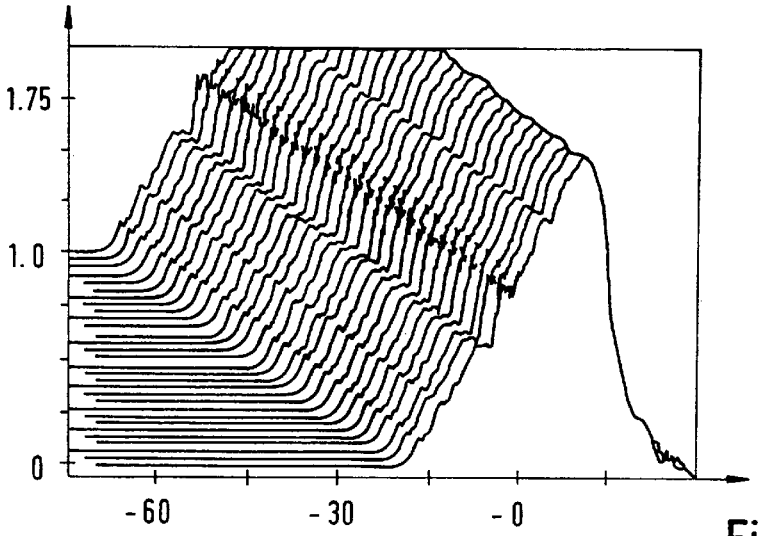
FIG. 5 is a view corresponding to that of FIG. 4 for a diesel internal-combustion engine with an injection system designed according to the present invention, for loading the nozzle needle in the closing direction, a spring being provided which is arranged in a closed spring chamber.

The measures according to the invention result in a clear stabilization of the injection pressure course and thus of the injection operation, as illustrated in FIGS. 4 and 5. Relative to an injection pressure course at a rotational speed of 2,300 r.p.m., FIG. 4 shows the pressure courses of an internal-combustion engine with a spring chamber connected to a leak oil pipe, while FIG. 5 shows the injection pressure course in the case of an internal-combustion engine equipped with an injection nozzle according to the invention. A comparison of FIGS. 4 and 5 should show that, by means of the nozzle design according to the invention, the instabilities in the injection pressure course are clearly reduced. This renders the nozzle needle movements more uniform, in which case the reduction of the instabilities offers the possibility that lower injection opening pressures can be used. This is also demonstrated by the representations according to FIGS. 4 and 5, in which the injection or pump delivery pressures are indicated in bar above the degree—crank angle. In the case of an injection device according to the invention shown in FIG. 5, the nozzle opening pressure is at 240 bar.

The nozzle construction according to the invention provides the basis for converting the advantages which can be achieved by an electronic control of the injection operation mechanically-hydraulically into an injection course which takes place precisely corresponding to the defined control data. The prerequisites for this injection course are provided by taking into account the spring chamber pressure, so that nozzles with spring chambers without any leak oil can be used in internal-combustion engines which are not only operated in a steady-state manner at a defined operating point but over the whole working range of an internal-combustion engine, as required for the vehicle operation. In conjunction with pump elements arranged close to the nozzle, thus, for example, in the case of plug-type pump systems as illustrated in the drawing, but also in connection with pump-nozzle elements, this can be carried out at a pressure level which is clearly above the pressure level which can be achieved in connection with in-line injection pumps, so that, on the whole, an improved mixture preparation and combustion can be achieved while the course of the combustion is more flexible and the power level of the internal-combustion engine is higher.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Fuel-injection diesel internal-combustion engine, comprising a fuel injection pump and a fuel injection nozzle communicated with said fuel injection pump, said fuel injection nozzle comprising:

at least one injection opening communicating with a combustion space of the engine;

a nozzle needle displaceable by fuel delivered by said pump to open said injection opening;

a closed, no-discharge spring chamber containing a pressure spring, wherein said spring chamber is connected with a delivery side of said pump by way of a throttling point formed by a sliding guide for said nozzle needle, such that said spring chamber fills with fuel, wherein said nozzle needle is loaded in a closing direction by said pressure spring and by the fuel pressure in said spring chamber, wherein the fuel pressure in said spring chamber is variable and is a function of a control position of said injection pump corresponding to a defined driving condition so that, when the pressure in said spring chamber rises above an operating pressure corresponding to the control position, a fuel delivery time of said injection pump is increased.

2. Fuel injection system for a diesel internal-combustion engine, comprising a fuel injection pump and a fuel injection nozzle, said fuel injection nozzle comprising:

a nozzle body comprising a fuel-feeding bore communicating with said fuel injection pump and a nozzle needle bore, wherein said nozzle needle bore is communicated with an injection opening;

a nozzle needle arranged in said nozzle needle bore that is displaceable between an open position in which said injection opening is open and a closed position in which said injection opening is closed;

a spring chamber in which a spring is arranged;

a pressure linkage coupling said spring to said nozzle needle such that said spring biases said nozzle needle toward said closed position, a throttling passage between said pressure linkage and said nozzle body, said throttling passage communicating said fuel-feeding bore with said spring chamber to allow fuel to flow into said spring chamber, wherein said spring chamber is closed except for said throttling passage, wherein the fuel pressure in said spring chamber is variable and is a function of a control position of said injection pump corresponding to a defined driving condition, so that, when the pressure in said spring chamber rises above an operating pressure corresponding to the control position, a fuel delivery time of said injection pump is increased.

3. Fuel-injection diesel internal-combustion engine, comprising a fuel injection pump and a fuel injection nozzle communicated with said fuel injection pump, said fuel injection nozzle comprising:

at least one injection opening communicating with a combustion space of the engine;

a nozzle needle displaceable by fuel delivered by said pump to open said injection opening;

a closed, no-discharge spring chamber containing a pressure spring, wherein said spring chamber is connected with a delivery side of said pump by way of a throttling point formed by a sliding guide for said nozzle needle, such that said spring chamber fills with fuel, wherein said nozzle needle is loaded in a closing direction by said pressure spring and by the fuel pressure in said spring chamber, wherein the injection nozzle is connected without a valve to a delivery side of the injection pump, wherein the fuel pressure in said spring chamber is variable and is a function of a control position of said injection pump corresponding to a defined driving condition so that, when the pressure in said spring chamber rises above an operating pressure corresponding to the control position, a fuel delivery time of said injection pump is increased.

4. Fuel injection system for a diesel internal-combustion engine according to claim 2, further comprising an electronic central timing control unit.

5. Method of operating a fuel injection system according to claim 1, comprising:

determining a control position of said injection pump corresponding to a defined driving condition over an entire working range of the engine; and increasing a fuel delivery time of said injection pump when the pressure in said spring chamber of the injection nozzle rises above an operating pressure corresponding to the control position.

6. Fuel-injection diesel internal-combustion engine according to claim 1, wherein at least one of a fuel delivery quantity, a fuel delivery pressure, and a fuel delivery time of said injection pump is controlled as a function of at least one of an engine load and an engine rotational speed.

7. Fuel injection internal-combustion engine according to claim 13, wherein a rise of the pressure in the spring chamber is determined by an engine rotational speed which falls as the pressure rises.

8. Fuel injection diesel internal-combustion engine according to claim 1, wherein as the result of the increase of the delivery time of the injection pump, the pressure in the spring chamber rises asymptotically with respect to a limit value which, in addition to the spring force, exercises a closing force on the nozzle needle and which is lower than the increased opening force achieved by prolonging the delivery time.

9. Fuel injection diesel internal-combustion engine according to claim 1, wherein the injection nozzle is connected without a valve to the delivery side of a plug-type injection pump.

10. Fuel injection diesel internal-combustion engine according to claim 1, wherein the injection pump is connected with the injection nozzle to form a pump-nozzle unit, in which the delivery side of the pump is connected without a valve to the injection nozzle.

11. Fuel injection diesel internal-combustion engine according to claim 1, wherein the pressure spring is arranged radially largely without contact in the spring chamber such that the spring chamber and the pressure spring form a vibration damper.

12. Fuel injection diesel internal-combustion engine according to claim 11, wherein the spring chamber forms a slide guide for the pressure spring in which the fuel acts as a sliding film.

13. Fuel injection system according to claim 2, wherein said nozzle needle is additionally biased toward said closed position by fuel pressure in said spring chamber.

* * * * *